US005167602A

United States Patent [19]

Lehktman

[11] Patent Number: 5,167,602

[45] Date of Patent: Dec. 1, 1992

[54] UNIVERSAL BODY EXERCISE UNIT

[76] Inventor: Gregory Lehktman, 1260 Dr. Penfield Ave., Apt. 902, Montreal, Quebec, Canada, H3G 1B6

[21] Appl. No.: 771,175

[22] Filed: Oct. 3, 1991

[51] Int. Cl.[5] ..... A63B 21/02

[52] U.S. Cl. ..... 482/131; 482/91

[58] Field of Search ..... 482/91, 131, 122; 128/28, DIG. 15, 30.2

[56] References Cited

U.S. PATENT DOCUMENTS

| | | | |
|---|---|---|---|
| 620,346 | 2/1899 | Meuller | 482/131 |
| 2,699,163 | 1/1955 | Engstrom | 128/30.2 |
| 3,503,388 | 3/1970 | Cook | 128/28 |
| 4,273,130 | 6/1981 | Simpson | 128/DIG. 15 |
| 4,422,455 | 12/1983 | Olsen | 128/DIG. 15 |
| 4,852,873 | 8/1984 | O'Donnell | 482/122 |

*Primary Examiner*—Richard J. Apley
*Assistant Examiner*—Jerome Donnelly
*Attorney, Agent, or Firm*—Chilton, Alix & Van Kirk

[57] ABSTRACT

A support body of a flexible material has a first handle extending from one end of the body and a second handle extending from the second end. The support body is disposed in engagement with one part of an exerciser and the handles are grasped in the hands of the exerciser. Thus, the driving force of the arms of the exercise are used against the restraining force of the one part of the body. The support body may be made up of two flexible members which are detachably and adjustably attachable to each other. Alternatively, it may comprise a single flexible member.

11 Claims, 4 Drawing Sheets

Fig. 6
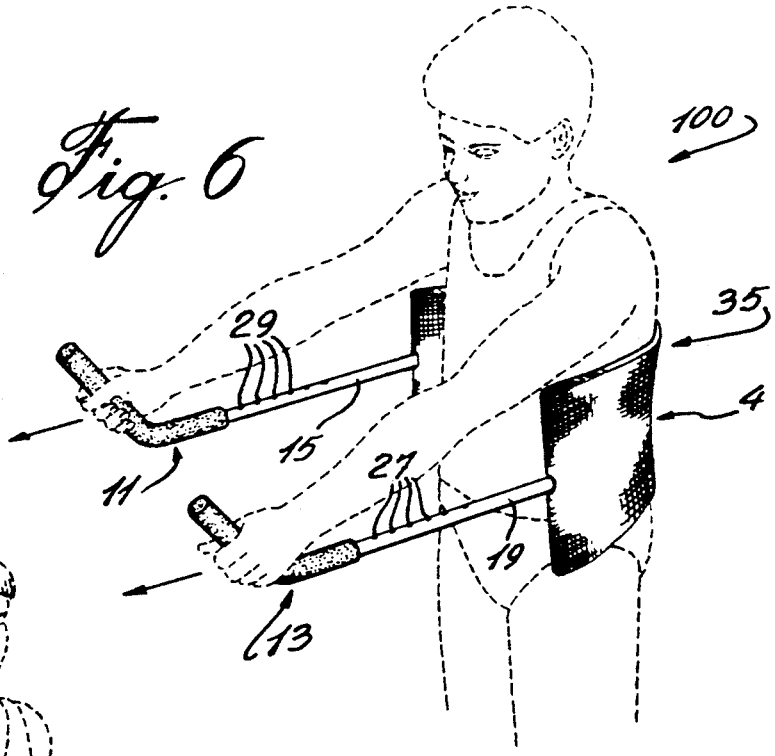
Fig. 8
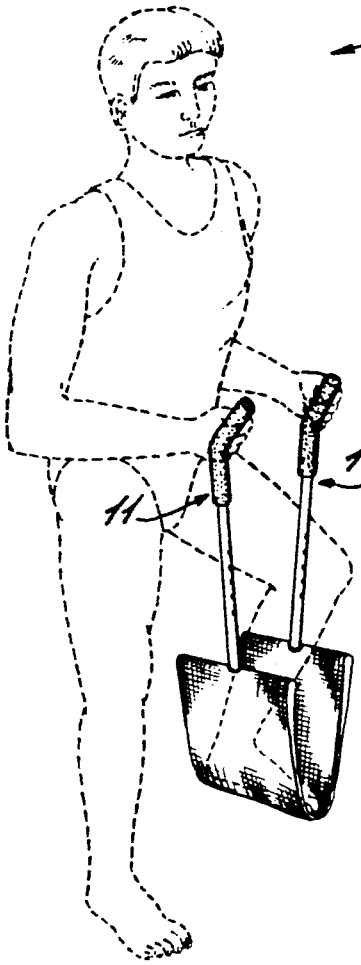
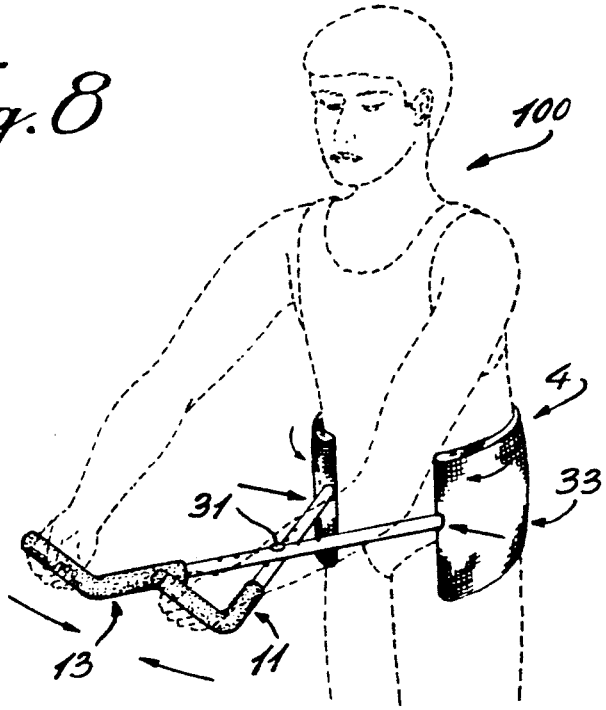
Fig. 5

UNIVERSAL BODY EXERCISE UNIT

BACKGROUND OF INVENTION

1. Field of the Invention

The invention relates to a universal body exercise unit. More specifically, the invention relates to such an exercise unit wherein driving force of one part of the body acts against a restraining force of a different part of the body to exercise both parts of the body. The exercise unit of the invention is completely safe, completely portable and relatively inexpensive.

2. Description of Prior Art

Although it is known to exercise by applying the driving force of one part of a body to act against the restraining force of another part of the body, for example, the hands of an exerciser can be disposed so that the palms of the hands face each other and one hand pushes down while the other pushes up, these exercises are performed without the aid of any apparatus so that only certain restricted parts of the body can be exercised in this way.

Exercise apparatus typically consists of an external force, which constitutes the restraining force, against which the driving force of different parts of the body are acted on. For example, barbells constitute such a restraining force as do weights drawn through a pulley. In stationary bicycles, the restraining force is a brake or the like applied to the wheel of the bicycle.

Such apparatus are, of course, relatively expensive and not very portable. In addition, such apparatus can be dangerous if an exerciser tries to lift too heavy a weight or applies too large a braking force. In attempting to overcome the restraining force, the exerciser can easily hurt himself.

In addition, such apparatus can be used only in specialized locations such as gymnasiums, which is not always convenient. For example, they could not be easily used in an office or other workplace or in the living room of a home.

Further, such apparatus are typically specialized for the exercise of only specific parts of the body.

SUMMARY OF INVENTION

It is therefore an object of the invention to provide a universal body exercise unit.

It is a further object of the invention to provide such a unit wherein the driving force of one part of the body acts against the restraining force of another part of the body.

It is a still further object of the invention to provide such a universal body exercise unit which is completely safe.

It is a still further object of the invention to provide such a universal body exercise unit which is completely portable.

It is a still further object of the invention to provide such a universal body exercise unit which is relatively inexpensive.

In accordance with the invention there is provided a universal body exercise unit comprising:

a support body comprising a flexible material and having a first end and a second end;

a first handle extending from said first end and a second handle extending from said second end;

wherein, the support body is disposed in engagement with one part of the body of an exerciser and the handles are grasped in the hands of said exerciser;

whereby, the driving force of the arms of the exerciser act against the restraining force of the one part of the body.

BRIEF DESCRIPTION OF DRAWINGS

The invention will be better understood by an examination of the following description, together with the accompanying drawings, in which:

FIG. 5 illustrates one type of exercise which can be performed with the exercise unit in accordance with the invention;

FIG. 6 illustrates a second type of exercise which can be performed with an exercise unit in accordance with the invention;

FIG. 8 illustrates a fourth type of exercise which can be performed with an exercise unit in accordance with the invention;

DESCRIPTION OF PREFERRED EMBODIMENTS

Figure 1:
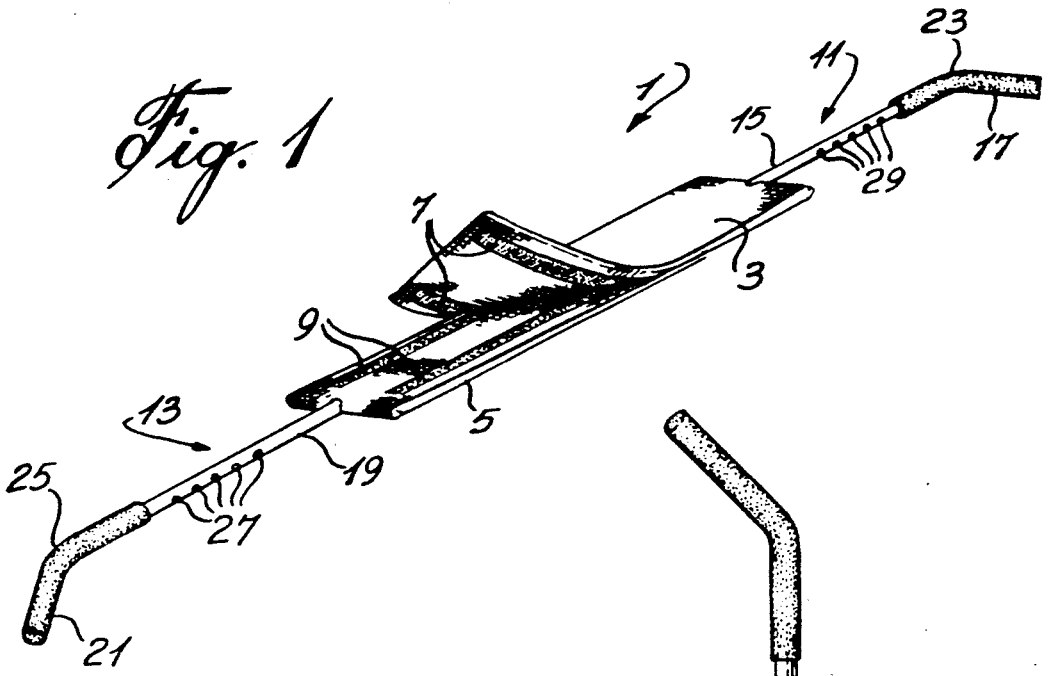
FIG. 1 illustrates one embodiment of the invention in plan view.
Figure 2:
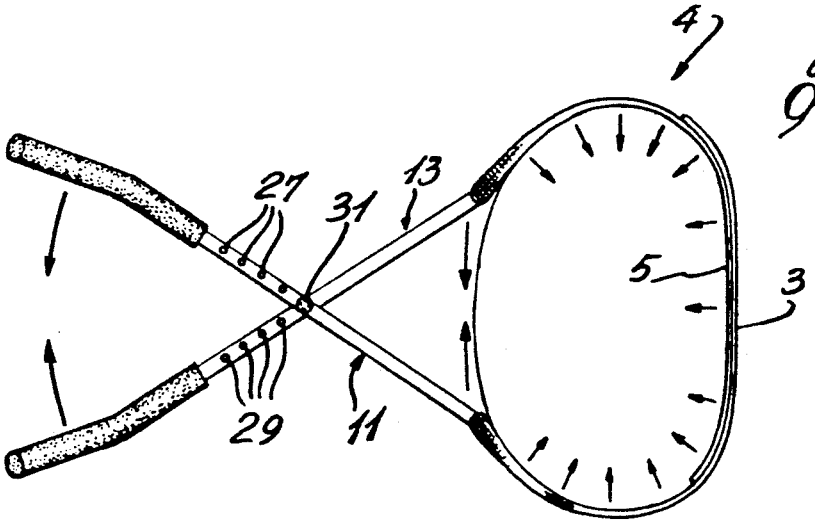
FIG. 2 is a top view of the exercise unit illustrated in FIG. 1.

Referring to FIGS. 1 and 2, the universal body exercise unit, illustrated generally at 1, comprises a first member 3 of a flexible material and a second member 5 of a flexible material. The material can comprise any sturdy cloth, for example, denim or the like. As forces will be applied against the flexible material, it is necessary that the material be sturdy. However, it must also be completely flexible.

Attachment means 7 are applied to one surface of the flexible member 3 and mating attachment means 9 are applied to one surface of the flexible member 5. Although different attachment means, as is well known in the art, could be used for the purpose of attaching the first flexible member to the second flexible member, in a particular embodiment, the attachment means 7 and 9 comprise mating Velcro TM strips.

It can be seen that the attachment of the first flexible member 3 to the second flexible member 5 is adjustable, i.e., the length of the combined flexible members can be adjusted. The attached flexible members together form a support body 4.

Extending from the free end of the flexible member 3 is a handle 11, and extending from the free end of the flexible member 5 is a handle 13. The handles are cylindrical and each handle comprises a first straight portion 15,19 and a second straight portion, 17,21 at an angle to the first straight portion. Preferably, the first and second portions of each handle are integrally formed.

A cover 23 covers all of the second straight portion 17 and a part of the first straight portion 15, and a cover 25 covers all of the second straight portion 21 and a part of the first straight portion 19. The covers 23 and 25 are of a sponge-like material which permits a good grip of the handle and also absorbs perspiration from the hands of the exerciser.

The first straight portion 15 of the handle 11 includes a plurality of spaced holes 27, and the straight portion 19 of the second handle 13 includes a plurality of spaced openings 29. A pin 31 (see also FIG. 3) is used to adjustably connect the handle 11 to the handle 13 as illustrated in FIG. 2. As can be seen in FIG. 2, the handle 11 overlies the handle 13 and the pin 31 extends through one hole of the handle 11 and through one hole of the handle 13. Thus, the handles are detachably and adjustably attached to each other.

Figure 4:
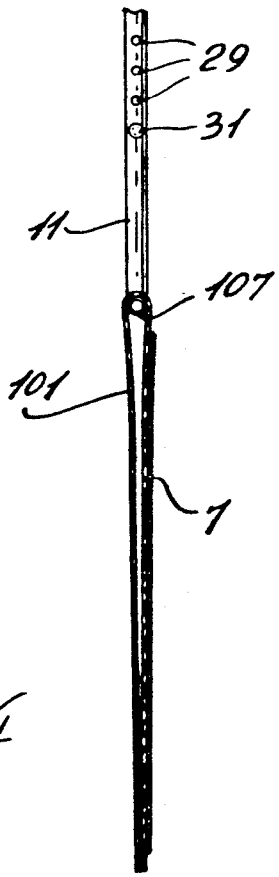
FIGS. 3 and 4 illustrate the construction of the flexible member and the means for securing the handle to the flexible member.
Figure 3:
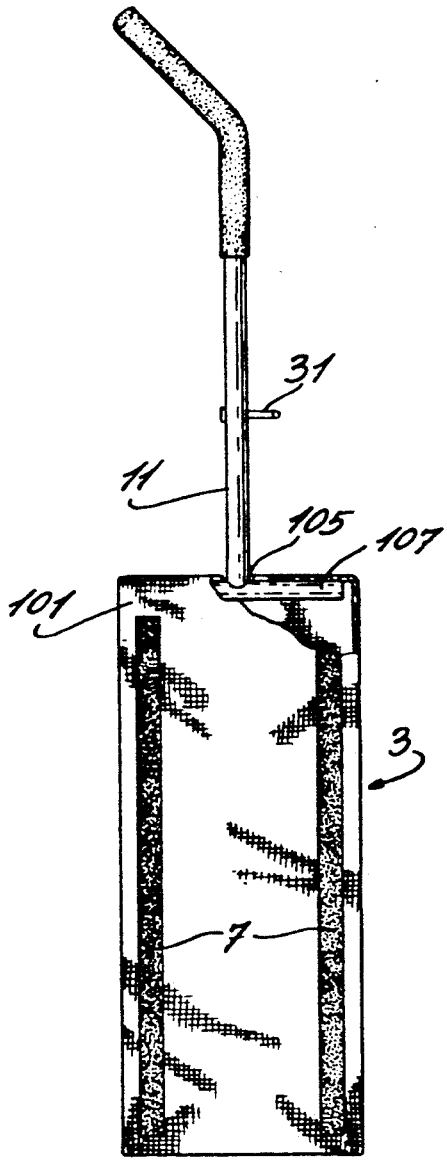

As seen in FIGS. 3 and 4, each of the flexible members 3 or 5 is rectangular in shape and comprises a bag-like portion 101 at one end thereof. The respective handles 11 or 13 extend through an opening 105 in the bag-like portion, and a cross-bar 107, attached to the handle 11, is provided to retain the handle in the bag-like portion against pulling forces of the handle.

The operation of the exercise unit will be described in association with FIGS. 5 to 8.

Referring to FIG. 5, it can be seen that the support body 4 is disposed in engagement with the buttocks 33 of an exerciser 100. The handles 11 and 13 are attached by pin 31 and a separate one of the handles is grasped by a respective one of the hands of the exerciser. The exerciser then moves his arms outwardly to provide a squeezing and pulling force to the buttocks of the exerciser. It is a well known principle in physics that, to every action, there is an equal and opposite reaction. In this case, the buttocks of the exerciser will provide a restraining force against the driving force of the arms of the exerciser. These forces will act against each other in dynamic motion, as when the arms are being moved, and in static tension, as when the arms remain in an outstretched position, pulling and squeezing on the buttocks. The arms can then be moved so that the ends of the handles are moved towards each other and the inward and outward movement of the arms is repeated as often as desired.

Referring to FIG. 6, the support body is placed in engagement with the back 35 of the exerciser 100. In this case, the handles are not connected to each other but remain in somewhat parallel disposition. The exerciser flexes his elbows so that the handles move forwardly against the restraining force of the back. Once again, the driving force of the arms acts against the restraining force of the back in both dynamic motion and static tension.

Figure 7:
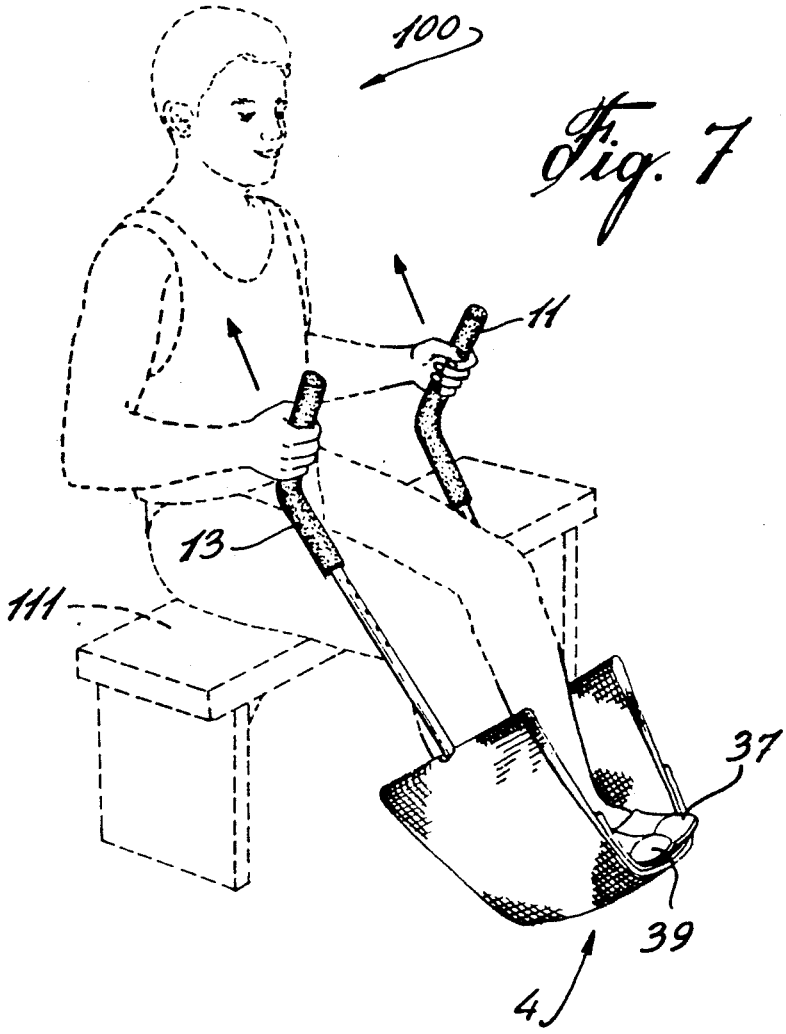
FIG. 7 illustrates a third type of exercise which can be performed with an exercise unit in accordance with the invention.

Referring now to FIG. 7, in this exercise, the support member is placed against the bottoms of the feet 37 and 39 of the exerciser 100. Once again, the handles 11 and 13 are not connected to each other but remain in parallel disposition. In this exercise, the exerciser will flex and extend his arms and, in synchronism therewith, flex and extend his legs. When the legs and arms are being flexed, the arms provide the driving force and the feet the restraining force. When the arms and legs are being extended, the legs provide the driving force and the arms provide the restraining force. Alternatively, the exerciser can keep the legs fully extended and flex the arms as much as he can, or he can keep the arms fully extended and flex the legs as much as he can. In the former case, the arms provide the driving force and the legs the restraining force, whereas, in the latter case, the legs provide the driving force and the arms the restraining force.

Although, in FIG. 7, the exerciser is shown sitting on a bench 111, the same exercise could be performed sitting on the floor.

In FIG. 8, the support body is placed under only one foot 37 of the exerciser and the handles are held together in one hand of the exerciser. Of course, the handles could be disposed in parallel arrangement and one handle would be held in one hand of the exerciser while the other handle would be held in the other hand. The exercises performed in FIG. 8 are of a nature very similar to the exercises performed in FIG. 7.

Figure 9:
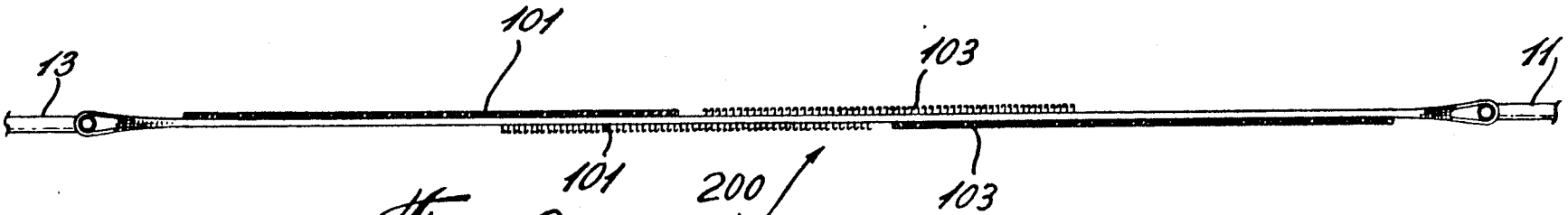
FIG. 9 illustrates an alternate form of the invention.

Although the above description implies a support body made of two flexible members, it will of course be obvious that the support body can comprise a single integral member such as illustrated at 200 in FIG. 9 which is rectangular in shape and which has a bag-like portion at either end thereof. In this case, the exercise unit can be provided in different standard sizes so that adjustment of the support body is not necessary. Alternatively, spaced attachment means 101 and 103 can be disposed on the same surface of the support body. It can be disposed on either such surface.

Figure 10:
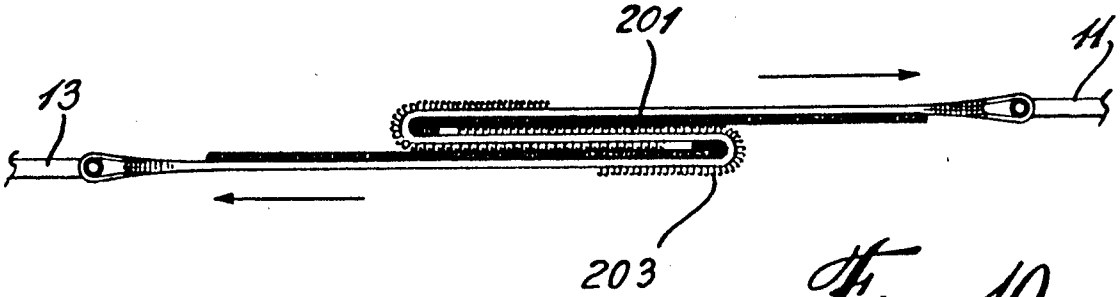
FIG. 10 illustrates the FIG. 7 embodiment in adjusted position.

In order to adjust the length of the support body in this embodiment, the support body is bent over itself until the attachment means 201 engages the attachment means 203 as illustrated in FIG. 10. To adjust to different lengths, different amounts of the support body will be bent over on itself.

In the embodiments illustrated in FIGS. 9 and 10, many different attachment means, as is well known to one skilled in the art, can be used. Once again, it is possible to use mating Velcro strips or Velcro patches.

As can be seen from the above description, with the inventive exercise unit, in FIGS. 5, 6, 7 and 8, the support device is broad enough so that the driving force of one part of the body acts against the restraining force of a different part. Accordingly, there is no danger in attempting to overcome too large a force in that, with the inventive exercise unit, the restraining force is, in effect, self-regulating.

It can also be seen that the inventive exercise unit is completely portable in that it can be easily folded up and carried from one place to another. As no installation is required, it can be used in an office, in a living room of a home, or in virtually any desired location.

It will also be seen that the materials used to fabricate the exercise unit are relatively inexpensive and that it requires very little work to make the exercise unit. Accordingly, the exercise unit is relatively inexpensive.

Although particular embodiments have been described, this was for the purpose of illustrating, but not limiting, the invention. Various modifications, which will come readily to the mind of one skilled in the art, are within the scope of the invention as defined in the appended claims.

I claim:

1. A universal body exercise unit comprising:

a rectangular support body comprising a flexible material and having a first end and a second end said support body having a first bag-like portion at said first end and a second bag-like portion at said second end;

a first handle comprising a first T-shaped member having a first elongated portion and a first cross-bar extending at right angles to said first elongated portion, and a second handle comprising a second T-shaped member having a second elongated portion and a second cross-bar extending at right angles to said second elongated portion;

said first bag-like portion having a first central opening at said first end and said second bag-like portion having a second central opening at said second end;

said first cross-bar being contained in said first bag-like member at said first end thereof, said first elongated portion extending through said first central opening and outwardly of said first bag-like member and said second cross-bar being contained in said second bag-like member at said second end thereof, said second elongated portion extending through said central opening and outwardly of said second bag-like member;

wherein, the support body is disposed in engagement with one part of the body of an exerciser and the handles are grasped in the hands of said exerciser;

wherein said support body is sufficiently broad so that the driving force of the arms of the exerciser act against the restraining force of the one part of the body.

2. A universal body exercise unit as defined in claim 1 wherein the dimensions of said support body are adjustable.

3. A universal body exercise unit as defined in claim 2 wherein the length of said support body is adjustable.

4. A universal body exercise unit as defined in claim 3 wherein said support body comprises:

a first flexible member, said first flexible member having a first end and a second end, said first end of said first flexible member corresponding with said first end of said support body;

a second flexible member, said second flexible member having a first end and a second end, said second end of said second flexible member corresponding with said second end of said support body;

whereby, said first bag-like portion is at said first end of said first flexible member, and said second bag-like portion is at said second end of said second flexible member;

attachment means on said members for detachably and adjustably attaching the members to each other.

5. A universal body exercise unit as defined in claim 4 wherein said attachment means comprise Velcro strips.

6. A universal body exercise unit as defined in claim 1 wherein each of said handles is cylindrical and has a first straight portion extending from a respective bag-like portion at a respective end of said support body, and a second straight portion at an angle to said first straight portion.

7. A universal body exercise unit as defined in claim 6 wherein a plurality of spaced holes extend through each said handle in the first straight portion thereof;

pin means;

the pin means extending through a hole in said first handle and a hole in said second handle when it underlies said first handle;

whereby, to detachably and adjustably attach the handles to each other.

8. A universal body exercise unit as defined in claim 7 wherein said first and second straight portions of each handle are integrally formed.

9. A universal body exercise unit as defined in claim 8 wherein a covering is provided on each of said handles, said covering extending over all of said second straight portion and a part of said first straight portion.

10. A universal body exercise unit as defined in claim 3 and including attachment means on one surface of said support body;

whereby, said flexible material of said support body can be bent over itself so that the attachment means engage each other;

whereby, to detachably adjust the length of said support body.

11. A universal body exercise unit as defined in claim 10 wherein said attachment means comprise Velcro strips.

* * * * *